US007648022B1

(12) United States Patent
Freeauf

(10) Patent No.: US 7,648,022 B1
(45) Date of Patent: Jan. 19, 2010

(54) PAINT TRAY WITH LID

(75) Inventor: Mark W. Freeauf, Pittsburgh, PA (US)

(73) Assignee: Mark Freeauf, Pittsburgh, PA (US)

( * ) Notice: Subject to any disclaimer, the term of this patent is extended or adjusted under 35 U.S.C. 154(b) by 546 days.

(21) Appl. No.: 11/226,600

(22) Filed: Sep. 15, 2005

(51) Int. Cl.
*B05C 21/00* (2006.01)
*B65D 85/00* (2006.01)

(52) U.S. Cl. ..... 206/15.3; 206/361; 220/570

(58) Field of Classification Search ..... 206/361, 206/15.2, 15.3, 523; 220/570, 902
See application file for complete search history.

(56) References Cited

U.S. PATENT DOCUMENTS 1,869,753 A * 8/1932 Kamm ..... 206/361
3,696,920 A * 10/1972 Lahay ..... 206/370
4,541,542 A 9/1985 Florentino
4,651,379 A 3/1987 Kern
4,971,271 A * 11/1990 Sularz ..... 248/68.1
5,314,061 A * 5/1994 Bedrossian ..... 206/229
5,533,228 A 7/1996 Jarecki et al.
5,553,701 A * 9/1996 Jarecki et al. ..... 206/15.2
5,645,164 A 7/1997 Hocking
D400,329 S 10/1998 Lindo
5,887,708 A 3/1999 Gonzales
6,092,675 A * 7/2000 Ramirez et al. ..... 211/68
6,199,718 B1 * 3/2001 Ellis ..... 220/570
6,530,470 B2 * 3/2003 Roundy ..... 206/15.3
7,083,044 B1 * 8/2006 Kilian et al. ..... 206/229

* cited by examiner

*Primary Examiner*—J. Gregory Pickett

(57) ABSTRACT

A tray includes a paint roller including a handle, a shaft conjoined thereto and a padded applicator positioned about the shaft. A pan includes front and rear sections, an opening for receiving paint and the roller therein, a flange portion protruding about a perimeter thereof, and a notch formed medially of a top surface of the front section. The notch has an arcuate lower edge. A lid is included to cover the opening of the pan and forms an air tight seal around a perimeter of the pan opening. The lid includes a lip portion extending downward from the lid and about a perimeter thereof, and has planar top and bottom surfaces. A proximal portion of the shaft is telescopically positional through the notch so that the user can house the roller within the pan while the lid is attached thereto.

5 Claims, 3 Drawing Sheets

FIG. 3

PAINT TRAY WITH LID

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a paint trays and, more particularly, to a paint tray with a lid for preventing paint from prematurely drying.

2. Prior Art

During extended painting of wall surfaces with a roller brush, the paint is commonly applied from a paint tray well known in the prior art. Typically the painter must expend a considerable amount of time in applying the paint over a number of shifts of several hours each. If the time between shifts is extended, such as overnight, the paint must be delicately poured back into the original can and then the brush and tray are thereafter washed so that the brush and paint do not become dry and therefore unusable. Such cleaning operations normally take a while, and for the typical homeowner involved in a number of household tasks, the repeated cleaning of the tray causes a time burden. The cleaning of the containers is simply inconvenient to carry out.

In addition to the time inconvenience, the user often gets paint upon his or her hands while cleaning the tray and roller. Moreover, the cleaned brush and roller become unusable until time for them to completely dry has elapsed. If the tray and roller is left without cleaning, the roller may become brittle or become accumulated with coagulated paint, making smooth application of subsequent paint layers both inconvenient and untidy.

Attempts have been made to address the above disadvantages but none to our knowledge has been sufficiently successful to go into widespread commercial use. For example, a number of proposals have been made involving a mating cover for a paint tray but many, and possibly a majority, of the proposed structures attempt to make provision to also contain the roller in the closed space formed by the tray and associated cover. Such a construction does however have inherent disadvantages in that all, or nearly all, paint trays include an inclined ramp near the rear thereof for the purpose of "rolling out" or distributing a fresh roller load of paint after dipping into the paint pool so that the paint is evenly distributed on the roller prior to application to a receiving surface.

The surface of the inclined ramp becomes coated with wet and sticky paint during use and hence if the brush handle is laid thereon preparatory to closing the cover on the tray, the handle becomes sticky and unusable thereby requiring cleaning prior to recommencing use. To overcome this drawback additional structure has been proposed to hold the handle away from the wet ramp. While such an arrangement may be functional, the resultant structure is impractical in that, by and large, the lid and/or tray, and particularly the lid, may not then be manufactured by the conventional thermoform process due to the structural complexity of the structure.

Accordingly, a need remains for a paint tray with lid in order to overcome the above-noted shortcomings. The present invention satisfies such a need by providing a paint tray with a lid that is easy and convenient to use, prevents unsightly spills, preserves and conserves paint and results in considerable time savings. Such an apparatus eliminates the need for the tray to be cleaned after each painting session. The apparatus conveniently allows the paint roller to be stored overnight in the tray without the handle thereof coming in contact with the remaining paint in the tray. The lid also has an easy lift-off design that allows the tray to be used by young and old persons alike. Such a tray is especially appealing to commercial and do-it-yourself painters that are attempting a painting project that will require more than one day's worth of painting.

BRIEF SUMMARY OF THE INVENTION

In view of the foregoing background, it is therefore an object of the present invention to provide a paint tray with a lid. These and other objects, features, and advantages of the invention are provided by a portable paint tray including a lid for preventing paint from drying.

The tray includes a paint roller including a handle and a shaft directly conjoined thereto. Such a roller further includes a padded applicator removably and rotatably positioned about the shaft.

A pan includes front and rear sections and an opening defining a receptacle for receiving paint and the roller therein. The front section preferably has a volume less than a volume of the rear section. The front section may include a plurality of coextensive and equidistantly spaced ridges protruding upwardly from a bottom surface thereof. Such ridges advantageously and conveniently enable a user to remove excess paint from a paint roller.

Such a pan also includes a notch formed medially of a top surface of the front section. The notch has an arcuate lower edge for advantageously assisting the user to maneuver the roller along the lower edge during operating conditions. The pan further includes a monolithically formed flange portion protruding outwardly and inwardly from a top surface of the pan and about a perimeter of the opening.

The present invention further includes a lid sized and shaped to conveniently and effectively cover the opening of the pan. Such a lid advantageously forms an air tight seal around a perimeter of the opening of the pan. The lid includes a monolithically formed lip portion extending orthogonally downward from the lid and about a perimeter thereof. Such a lid further has substantially planar top and bottom surfaces, respectively. A proximal portion of the shaft is telescopically positional through the notch so that the user can conveniently house the roller within the pan while the lid is attached thereto. The lid preferably includes at least one finger member monolithically formed with the lip portion. Such a finger member extends orthogonally and outwardly from the lip portion.

The tray may further include a deformably resilient foam insert removably positional in the notch. Such an insert has an aperture centrally formed therein and a slot extending from a top edge of insert downward to the aperture for effectively bifurcating the foam insert. The insert has an arcuate lower edge for advantageously assisting the user to maneuver the roller along the lower edge during operating conditions. The aperture of the insert preferably effectively and conveniently receives a handle of the paint roller when the shaft of the roller is slidably adapted through the slot and positioned in the aperture. Such an insert is resiliently adaptable between expanded and equilibrium positions such that rollers of varying sizes can advantageously be inserted into the aperture and maintained at a substantially stable position during non-operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
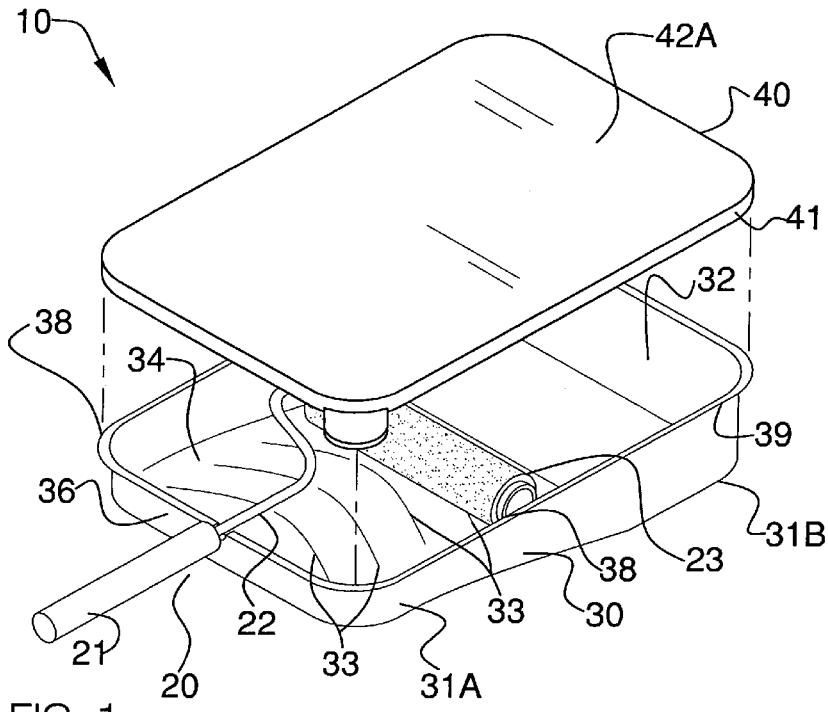
FIG. 1 is a perspective view showing a paint tray with lid, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a paint tray with a lid. It should be understood that the apparatus 10 may be used to protect many different types of pigmented fluids and should not be limited in use to protecting only paint.

Referring initially to FIG. 1, the apparatus 10 includes a paint roller 20 including a handle 21 and a shaft 22 directly conjoined, with no intervening elements, thereto. The handle advantageously provides a convenient gripping area by which a user can grasp and maneuver the roller 20. Such a roller 20 further includes a padded applicator 23 removably and rotatably positioned about the shaft 22. Of course, the roller 20 may incorporate a variety of applicators 23, such as those consisting of wool, sponge, nylon, etc., as is obvious to a person of ordinary skill in the art.

Figure 2:
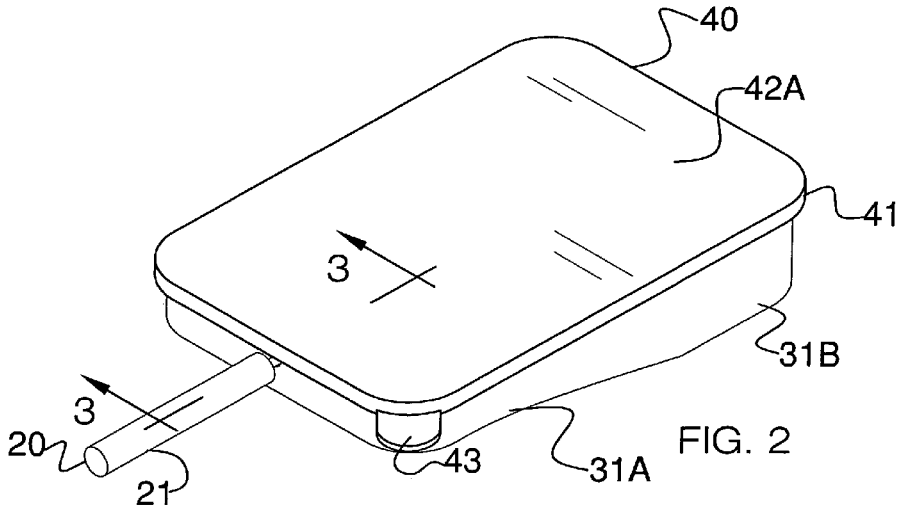
FIG. 2 is a perspective view of the apparatus shown in FIG. 1, showing the lid attached to the tray opening.
Figure 3:
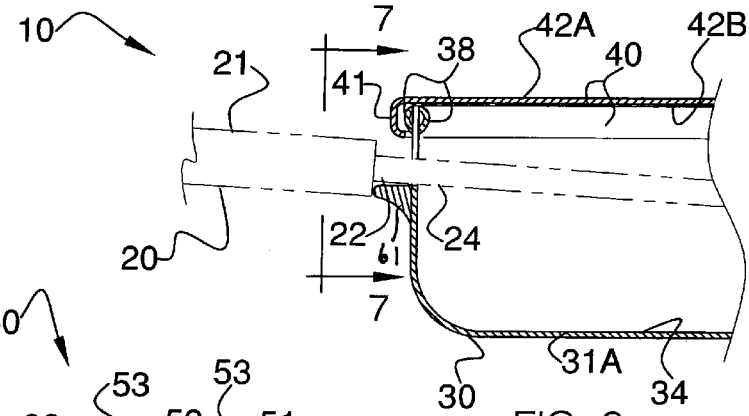
FIG. 3 is a cross-sectional view of the apparatus shown in FIG. 2, taken along line 3-3 and showing the paint roller shaft positioned through the insert.

Referring to FIGS. 1, 2 and 3, a pan 30 includes front 31A and rear 31B sections and an opening 32 defining a receptacle that is essential and convenient for receiving paint and the roller 20 therein. The front section 31A has a volume less than a volume of the rear section 31B. The front section 31A includes a plurality of coextensive and equidistantly spaced ridges 33 protruding upwardly from a bottom surface 34 thereof. Such ridges 33 advantageously and conveniently enable a user to remove excess paint from a paint roller 20, which is critical and advantageous for ensuring that the paint is applied evenly to the intended surface. The bottom surface 34 of the front section 31A slopes downwardly towards the rear section 31B, which is important for allowing paint removed by the ridges 34 to flow back to the rear section 31B.

Figure 4:
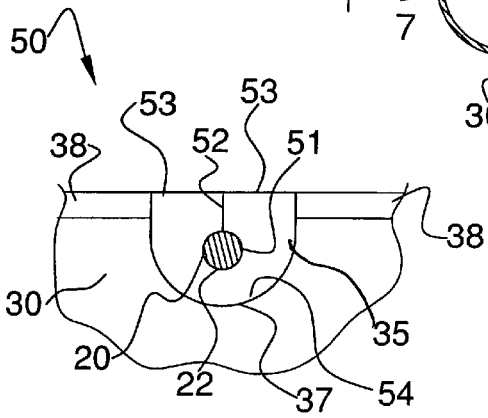
FIG. 4 is a cross-sectional view of the shaft shown in FIG. 3, taken along line 4-4.

Referring to FIGS. 1, 2 and 4, such a pan 30 also includes a notch 35 formed medially of a top surface 36 of the front section 31A. The notch 35 has an arcuate lower edge 37 that is important and advantageous for assisting the user to maneuver the roller 20 along the lower edge 37 during operating conditions. The pan 30 further includes a monolithically formed flange portion 38 protruding outwardly and inwardly from a top surface 39 of the pan 30 and about a perimeter of the opening 32.

Referring to FIGS. 1, 2, 3 and 5, the present invention further includes a lid 40 sized and shaped to conveniently and effectively cover the opening 32 of the pan 30. Such a lid 40 advantageously forms an air tight seal around a perimeter of the opening 32 of the pan 30, which is essential for preventing paint and a roller 20 stored therein from drying out over extended periods of time. This effectively and advantageously eliminates the need to wash the pan 30 and the roller 20 after each use, especially if subsequent use thereof will be required within 24 hours. The lid 40 also effectively prevents debris, such as dust and dirt from contaminating the paint housed in the pan 30. A further advantage of the lid 40 is that same allows a user to walk about with the apparatus 10 without having to be concerned with spilling paint from the pan 30 while the lid 40 is positioned thereover.

Still referring to FIGS. 1, 2, 3 and 5, the lid 40 includes a monolithically formed lip portion 41 extending orthogonally downward from the lid 40 and about a perimeter thereof. The lip portion 41 effectively engages the flange portion 38 of the pan 30, which is important for forming an air tight seal about the entire circumference of the apparatus 10. Such a lid 40 further has substantially planar top 42A and bottom 42B surfaces, respectively. A proximal portion 24 of the shaft 22 is telescopically positional through the notch 35 so that the user can conveniently house the roller 20 within the pan 30 while the lid 40 is attached thereto. This feature conveniently eliminates the need to place the entire roller 20 within the pan 30, which would otherwise lead to wet paint coming into contact with the handle 21 of the roller 20, causing same to become sticky and inconvenient to use.

Figure 5:
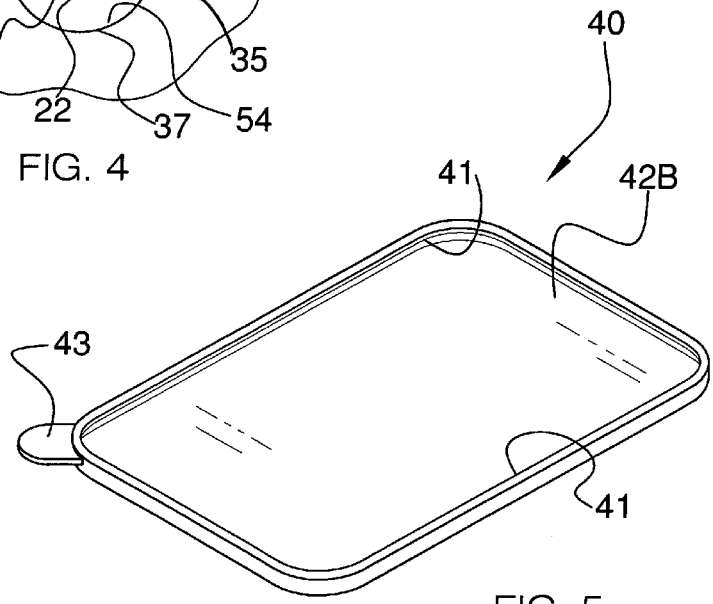
FIG. 5 is a bottom perspective view of the lid shown in FIGS. 1 and 2, showing the lip portion extending thereabout.

Referring to FIGS. 1, 2 and 5, the lid 40 also includes at least one finger member 43 monolithically formed with the lip portion 41. Such a finger member 43 extends orthogonally and outwardly from the lip portion 41, thus providing a convenient gripping point where a user may grasp the lid 40 to quickly and easily remove same from the pan 30 with little or no effort. Of course, the pan 30 and the lid 40 may be produced in a variety of different sizes, so as to accommodate various painting applications and alternately sized rollers 20, as is obvious to a person of ordinary skill in the art.

Referring to FIGS. 1 through 4, the tray 10 further includes a deformably resilient foam insert 50 removably positional in the notch 35. Such an insert 50 has an aperture 51 centrally formed therein and a slot 52 extending from a top edge 53 of the insert 50 downward to the aperture 51 for effectively bifurcating the foam insert 50. The insert 50 has an arcuate lower edge 54 for advantageously assisting the user to maneuver the roller 20 along the lower edge 37 during operating conditions. The aperture 51 of the insert 50 effectively and conveniently receives a handle 21 of the paint roller 2Q when the shaft 22 of the roller 20 is slidably adapted through the slot 52 and positioned in the aperture 51. Such an insert 50 is resiliently adaptable between expanded and equilibrium positions, which is vital such that rollers 20 of varying sizes can advantageously be inserted into the aperture 51 and maintained at a substantially stable position during non-operating conditions. The deformably resilient nature of the insert 50 allows same to become closely engaged about the shaft portion 24 positioned through the aperture 51, which is critical for further limiting the paint held in the pan 30 from being exposed to the air.

Figure 6:
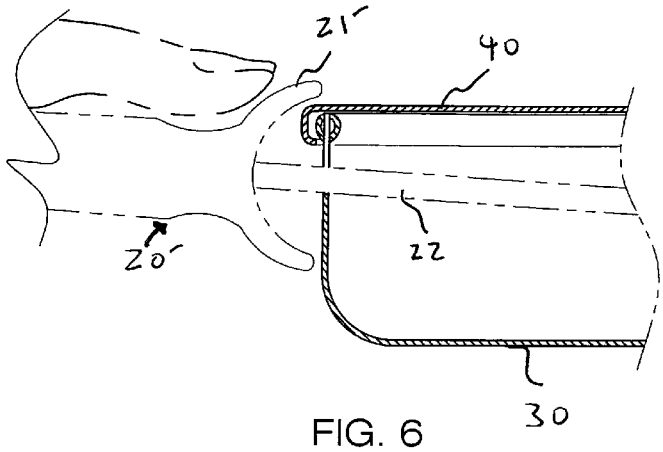
FIG. 6 shows an alternate embodiment including a roller with a C-shaped handle for fitting over the pan lid.
Figure 7:
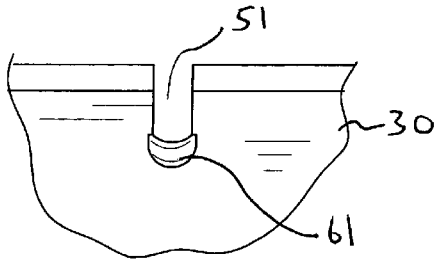
FIG. 7 shows yet another embodiment wherein a recessed lip portion is provided so that the lid can directly engage the pan and not the roller handle.

Referring to FIGS. 6 and 7, the paint roller 20' is provided with a C-shaped distal end portion 21' that is suitably sized for resting directly on the lid 40 for assisting to maintain the lid 40 at a closed and flush position against the pan 30. Such a C-shaped end portion 21' also provided a contoured or beveled surface onto which the user may position his/her thumb when handling the paint roller 20'. A recessed lip portion 61 is monolithically formed with the insert 50 wherein the lip portion 61 provides a horizontally registered surface on which the paint roller shaft 22 can be rested for reducing the likelihood of tipping the paint roller 20 upwardly about the aperture 51 when the lid 40 is non-statically placed over the pan 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable paint tray including a lid for preventing paint from drying, said tray comprising:

a paint roller including a handle and a shaft directly conjoined thereto, said roller further including a padded applicator removably and rotatably positioned about said shaft;

a pan including front and rear sections and an opening defining a receptacle for receiving paint and said roller therein, said pan further including a notch formed medially of a top surface of said front section, wherein the notch has an arcuate lower edge for assisting the user to maneuver said roller along said lower edge during operating conditions, said pan further including a monolithically formed flange portion protruding outwardly and inwardly from a top surface of said pan and about an entire perimeter of the opening; and a lid sized and shaped to cover the opening of said pan, said lid forming an air tight seal around a perimeter of the opening of said pan, said lid including a monolithically formed lip portion extending orthogonally downward from said lid and about a perimeter thereof, said lid having substantially planar top and bottom surfaces, respectively;

wherein a proximal portion of said shaft is telescopically positional through the notch so that the user can house said roller within said pan while said lid is attached thereto;

wherein an insert and the notch have an arcuate lower edge for assisting the user to maneuver said roller along said lower edge during operating conditions;

wherein said lip portion covers said flange portion after said lid is attached to said pan such that said lip portion maintains a frictional engagement with said flange portion;

wherein said lid includes at least one finger member monolithically formed with said lip portion, said at least one finger member extending orthogonally and outwardly from said lip portion;

wherein said at least one finger member has an arcuate top surface contiguously traveling along a bottom surface of said notch so that the handles is evenly guided through said notch.

2. The tray of claim 1, wherein said tray further comprises: a deformably resilient foam insert removably positional in the notch, said insert having an aperture centrally formed therein and a slot extending from a top edge of insert downward to the aperture, said insert having an arcuate lower edge for assisting the user to maneuver said roller along said lower edge during operating conditions.

3. The tray of claim 2, wherein the aperture of said insert receives a handle of said paint roller when said shaft of said roller is slidably adapted through the slot and positioned in the aperture, said insert being resiliently adaptable between expanded and equilibrium positions such that rollers of varying sizes can be inserted into the aperture and maintained at a substantially stable position during non-operating conditions.

4. The tray of claim 1, wherein said front section has a volume less than a volume of said rear section.

5. The tray of claim 1, wherein said front section includes a plurality of coextensive and equidistantly spaced ridges protruding upwardly from a bottom surface thereof, said ridges for enabling a user to remove excess paint from a paint roller.

* * * * *